US007072605B2

(12) United States Patent
Kishigami

(10) Patent No.: US 7,072,605 B2
(45) Date of Patent: Jul. 4, 2006

(54) ROTARY DEVELOPMENT DEVICE AND IMAGE FORMING APPARATUS HAVING A DEVELOPMENT UNIT MOUNTED ON A ROTATING MEMBER

(75) Inventor: Minoru Kishigami, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 39 days.

(21) Appl. No.: 10/880,440

(22) Filed: Jun. 28, 2004

(65) Prior Publication Data

US 2005/0013632 A1 Jan. 20, 2005

(30) Foreign Application Priority Data

Jun. 30, 2003 (JP) ..... P2003-186568
Jul. 8, 2003 (JP) ..... P2003-193331

(51) Int. Cl.
*G03G 15/01* (2006.01)

(52) U.S. Cl. ..... 399/227

(58) Field of Classification Search ..... None
See application file for complete search history.

(56) References Cited

U.S. PATENT DOCUMENTS 6,650,855 B1 * 11/2003 Tajima ..... 399/227

FOREIGN PATENT DOCUMENTS

| | | |
|---|---|---|
| JP | 07-140769 | 6/1995 |
| JP | 07-175322 | 7/1995 |
| JP | 08-211689 | 8/1996 |
| JP | 11-024361 | 1/1999 |
| JP | 11-065276 | 3/1999 |
| JP | 11-295961 | 10/1999 |
| JP | 11-316479 | 11/1999 |
| JP | 2000-231261 | 8/2000 |
| JP | 2003-005484 | 1/2003 |

* cited by examiner

*Primary Examiner*—Quana Grainger
(74) *Attorney, Agent, or Firm*—Hogan & Hartson LLP

(57) ABSTRACT

A rotary development device includes a rotating member, a development unit which is detachably mounted on the rotating member, an engaging member which engages the rotating member and the development unit. The engaging member is provided so that a positioning pin is fitted into a positioning hole. The rotary development device further includes a biasing member which biases either the development unit or the rotating member so that the positioning pin is biased to inner face of the positioning hole.

9 Claims, 11 Drawing Sheets

ROTARY DEVELOPMENT DEVICE AND IMAGE FORMING APPARATUS HAVING A DEVELOPMENT UNIT MOUNTED ON A ROTATING MEMBER

BACKGROUND OF THE INVENTION

The present invention relates to a rotary development device which has a rotating member constituted by a rotary frame and a plurality of development units detachably mounted on the rotating member along a cylindrical outer circumference thereof and in which the development units are selectively rotated to a developing position opposite to an image bearing member to develop a latent image on the image bearing member, the invention also relating to an image forming apparatus.

Also, the present invention relates to an image forming apparatus having a configuration in which a plurality of development units are sequentially rotated to a developing position as a result of developing color switching operations of a rotary development device to form an image by developing a latent image formed on an image bearing member and transferring it onto a medium in a transfer position.

Image forming apparatus such as copying machines, printers, facsimile machines utilizing electrophotography include a type of apparatus in which electrostatic latent images in a plurality of colors are sequentially formed on a photosensitive member. The electrostatic latent images are sequentially developed into toner images in the respective colors with a rotary development device; the toner images in the respective colors are thereafter transferred onto an intermediate transfer medium in an overlapping relationship. A resultant full-color toner image transferred onto the intermediate transfer medium is transferred to a transfer member and is then fixed thereon.

In the above-described rotary development device, the rotating member is provided opposite to a photosensitive member; the plurality of development units (development units for yellow, cyan, magenta, and black) are mounted in the rotating member; the rotating member is rotated to put any of the plurality of development units in contact with a developing position of the photosensitive member selectively; and a developing bias is applied while rotating a development roller in the development unit to develop an electrostatic latent image into a toner image.

The color image forming apparatus having a rotary development device include a type of apparatus in which a development unit is urged toward a photosensitive member to put a roller, which is provided coaxially with a development roller, in abutment with the photosensitive member to position the photosensitive member in order to maintain a proper gap between the photosensitive member and the development roller. In this type of apparatus, variation of development units in the form of cartridges mounted on a rotary development device affects engagement between a drive input gear and a drive output gear, and the state of engagement between the drive input gear and the drive output gear varies for each cartridge or development unit of the respective color. From this point of view, proposals have been made on apparatus having a configuration in which an idler gear is provided in a position associated with each of development units of a rotary development device and in which a train of gears of the development unit is engaged with the idler gear, and the idler gear is engaged with a drive output gear in a developing position, the configuration allowing a development roller to be urged toward a photosensitive member with stability when a drive for development is transmitted and making it possible to maintain a gap between the photosensitive member and the development roller easily (see JP-A-2003-5484).

In the above related apparatus, a development unit is urged by the elastic member from behind and, in addition, a transmission reaction force generated by a drive for development is exerted in the direction of urging the development unit against the photosensitive member to rotate the development unit about the fulcrum and to urge it against the photosensitive member. Further, the fulcrum is inserted in the positioning hole of the development cartridge. Vibration coming from the driving source can be absorbed at the train of gears transmitting the drive to the development unit by urging the development unit against the photosensitive member utilizing such an elastic member or a transmission reaction force or by designing the material of the gear appropriately. In the fitting portion of the fulcrum, there is considerable looseness of fitting between a pin at the fulcrum and a hole to be fitted with the same in order to accommodate variation of the accuracy of the components and to allow the development cartridge to be smoothly attached and detached. Since vibration from the driving source primarily generated at the time of driving for development acts on such as loose fit, the development unit itself will have troubles such as an undesirable movement or resonance, which will results in the problem of image defects such as banding.

Further, an image forming apparatus employing the rotary developing method includes an image bearing member on which a latent image is formed, a plurality of development units which have a development roller and which convey a developing agent to develop a latent image, and a rotary development device which supports the plurality of development units along an outer circumference thereof and rotates them to a developing position opposite to the image bearing member. In the mage forming apparatus, a development unit performs a developing operation with the rotary development device positioned so that the axis of rotation of the rotary development unit, the axis of rotation of a development roller, and the axis of rotation of a photosensitive member are aligned on a straight line in the developing position (for example, see JP-B-2649033 and JP-A-2003-5484).

However, when a development unit performs a developing operation in the developing position in the related apparatus, some problems arise because the rotary development device is positioned so that the axis of rotation of the rotary development device, the axis of rotation of the development roller, and the axis of rotation of the photosensitive member are aligned on a straight line.

For example, when the developing operation is finished and the rotary development device is rotated by a developing color switching operation to rotate the development unit for the next color to the developing position, the urging force which has urged the development unit in the developing operation so far against the photosensitive member begins to decrease from a maximum value as the movement begins and becomes zero when the development roller completely separates from the photosensitive member. There are various methods for determining the distance between a development roller and a photosensitive member in a developing position. In an example of a non-contact developing method, a roller having a diameter slightly larger than that of a development roller is disposed coaxially with the development roller and the roller is put in abutment with a photosensitive member to determine the gap between the development roller and the photosensitive member. In a case that the above description of reduction of an urging force is applied to this configuration, there is zero urging force when the roller separates from the surface of the photosensitive member some time after the rotary development device rotates out of the developing position. In JP-A-2003-5484, the roller is described as a circular member at an edge of a development roller 122 as shown in FIGS. 2 and 3.

A change in the urging force that urges a development unit against the photosensitive member results in a change in a load for driving the photosensitive member. This causes an irregularity in the rotation of the photosensitive member and causes an image defect such as an irregularity in an image. There is some looseness when the photosensitive member is mounted in a main body of an apparatus. A certain degree of looseness is required for a structure to which the member is fit-mounted. When the development unit is urged against the photosensitive member, the photosensitive member moves in a leaving direction of leaving from the development roller on a straight line connecting the axis of rotation of the rotary development device, the axis of rotation of the development roller, and the axis of rotation of the photosensitive member, the movement staying within the range of such looseness. When the rotary development device starts rotating and the urging force decreases consequently just as described above in relation to the above-mentioned problem, the photosensitive member can move in the direction opposite to the leaving direction within the range of the looseness. Such changes in the position of the photosensitive member result in the problem of distortion of an image between a primary transfer roller and the photosensitive member (transfer deviation).

SUMMARY OF THE INVENTION

It is therefore a first object of the present invention to provide a rotary development device which prevents an undesirable movement of a development unit attributable to a loose fit of a fulcrum for swingably supporting the development unit to prevent the occurrence of image defects.

Also, it is therefore a second object of the present invention to provide an image forming apparatus which reduces an uneven rotation of a photosensitive member to eliminate exposure deviation and transfer deviation attributable to the uneven rotation, thereby eliminating irregularities or defects of an image and reducing time required for a developing color switching operation.

In order to achieve the first object, according to the present invention, there is provided a rotary development device, comprising:

a rotating member;

a development unit, which is detachably mounted on the rotating member;

an engaging member, which engages the rotating member and the development unit, the engaging member provided so that a positioning pin is fitted into a positioning hole; and a biasing member, which biases either the development unit or the rotating member so that the positioning pin is biased to an inner face of the positioning hole.

It is therefore possible to eliminate a loose fit between the positioning pin and the positioning hole to be fitted with the same at a fulcrum about which the development unit is swingably supported. As a result, it is possible to prevent problems such as an undesirable movement or resonance of the development unit attributable to vibration from a driving source that occurs when development is driven and to prevent the occurrence of image defects such as banding.

Preferably, the biasing member is provided in a vicinity of the engaging member.

Preferably, the rotary development device further comprises a photosensitive member on which a latent image is formed. The latent image is developed by the development unit. The biasing member applies a bias in a direction orthogonal to a line connecting an axis of rotation of the rotating member and an axis of rotation of the photosensitive member.

Preferably, the biasing member applies a bias toward the positioning pin of the engaging member.

Preferably, the biasing member is an elastic member which is provided between the rotating member and the development unit.

Preferably, the biasing member is an elastic member which is provided between the positioning pin and the positioning hole.

In the above configurations, no component force acts on the swing of a development unit, and pressurization can be performed with stability between the development roller and the photosensitive member.

Preferably, the positioning pin is provided on a pivotal shaft of an idler gear on the rotating member which is engaged with a drive output gear in a developing position. The positioning hole is provided on the development unit at a position corresponding to the positioning pin to be fitted.

Therefore, an idler gear that engages a development unit input gear of a development unit is located in the positioning region when the development unit is mounted, which allows the gears to be smoothly guided for engagement with a reduced positional shift or deviation.

According to the present invention, there is also provided a rotary development device, comprising:

a rotating member;

a development unit, which is detachably mounted on the rotating member;

an engaging member, which engages the rotating member and the development unit, the engaging member provided so that a positioning pin is fitted into a positioning hole; and an elastic member, which is provided on the positioning pin, wherein the elastic member is intimately contacted with inner circumference of the positioning hole.

Preferably, the elastic member has an annular shape. The elastic member is provided around an outer circumference of the positioning pin.

Also, in order to achieve the second object, according to the present invention, there is also provided an image forming apparatus, comprising:

a image bearing member;

a latent image forming member, which forms the latent image on the image bearing member;

a plurality of development units, each of which develops the latent image; and a rotating member, which supports the development units along an outer circumference thereof, and which rotatably moves the development units so as to sequentially arrange one development unit of the development units at a development position opposite to the image bearing member for developing the latent image, wherein the one development unit at the developing position is urged against downstream of the image bearing member with respect to a straight line connecting an axis of rotation of the rotating member and an axis of rotation of the image bearing member as viewed in a rotating direction of the image bearing member.

In the above configuration, the force urging the one development unit against the image bearing member can be reduced or moderated to reduce irregularities in the rotation of the image bearing member, which makes it possible to eliminate any exposure deviation and transfer deviation attributable to irregularities of the rotation and to thereby eliminate any irregularity or defect in an image.

Preferably, the one development unit at the developing position is left from the image bearing member for moving a next development unit to the developing position before transferring a development image which is developed from the latent image by the development unit to a medium.

Preferably, the latent image forming member forms the latent image after a next development unit is arranged at the developing position.

Preferably, each of the development units has a fulcrum which is swingably supported on the rotating member. The one development unit is urged toward downstream of the image bearing member with respect to the straight line as viewed in a rotating direction of the image bearing member about the fulcrum serving as a swing center.

Preferably, each of the development units has a development roller. The development roller of the one development unit at the developing position is urged against the image bearing member.

In the above configurations, it is possible to eliminate any transfer deviation attributable to irregularities of the rotation and to thereby eliminate any irregularity or defect in an image. Since the latent image forming member starts forming the latent image after the next development unit is rotated to the developing position as a result of a developing color switching operation of the rotating member, even if there is an irregularity of the rotation of the image bearing member during the developing color switching operation of the rotating member, any adverse effect of the same can be avoided. It is therefore possible to eliminate any exposure deviation attributable to the irregularity of the rotation and to thereby eliminate any irregularity or defect in an image. Further, since the development units have a fulcrum which is swingably supported and which is urged downstream of the axis of rotation of the image bearing member as viewed in the rotating direction of the image bearing member, the urging force of the development unit acting on the image bearing member can be reduced or moderated to reduce irregularities of the rotation of the image bearing member. It is therefore possible to eliminate any exposure deviation and transfer deviation attributable to irregularities of the rotation and to thereby eliminate any irregularity or defect in an image.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1A:
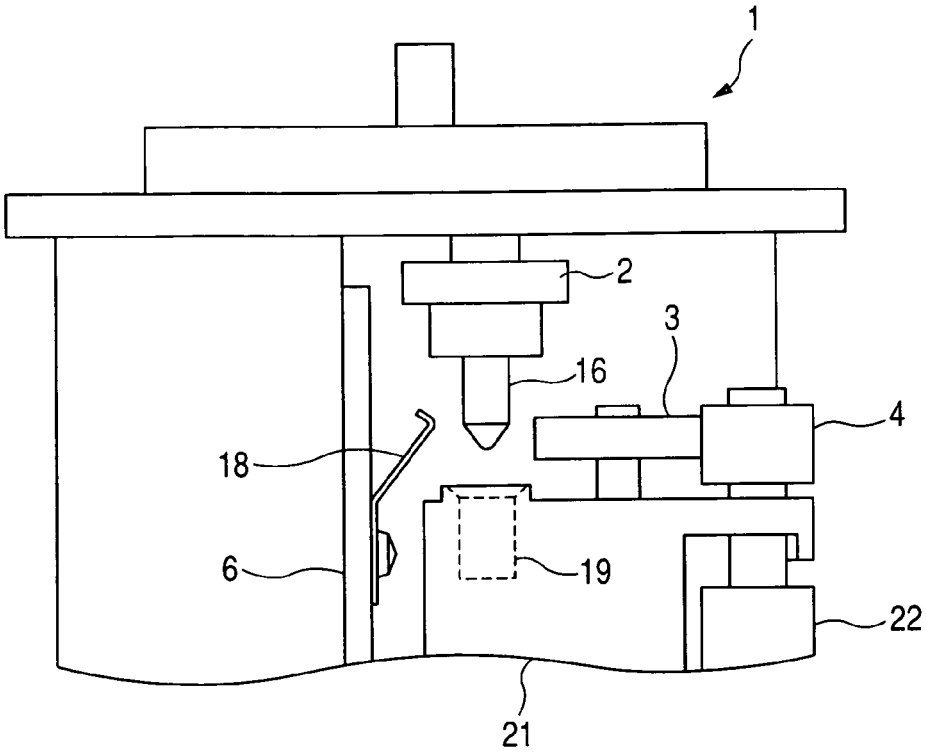
FIGS. 1A and 1B are illustrations showing a rotary development device according to a first embodiment of the invention.
Figure 1B:
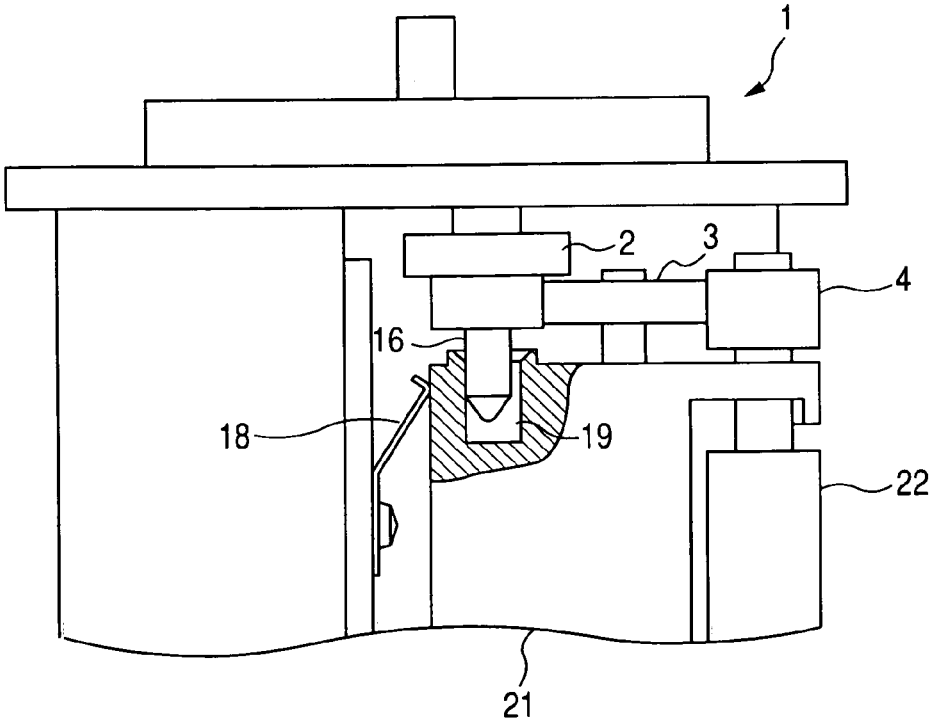

Embodiments of the invention will now be described with reference to the drawings. FIGS. 1A and 1B show a rotary development device according to the first embodiment of the invention. Reference numeral 1 represents the rotary development device, reference numeral 2 represents a rotary idler gear, reference numeral 3 represents an input gear of a development unit, reference numeral 4 represents a development roller gear, reference numeral 6 represents a rotary-frame, reference numeral 16 represents a positioning pin, reference numeral 18 represents an elastic member for preventing a loose fit, reference numeral 19 represents a positioning hole, reference numeral 21 represents a development unit, and reference numeral 22 represents a development roller.

Referring to FIGS. 1A and 1B, in the rotary development device 1, a plurality of development units 21 are mounted on a rotating member that is constituted by a rotary frame 6 along a cylindrical outer circumference of the same. Each of the development units 21 is selectively rotated to a developing position opposite to a photosensitive member 23 (not shown) through a developing color switching operation. The development unit 21 is urged to swing into contact with the photosensitive member 23 to develop a latent image on the photosensitive member 23. When the rotary development device 1 is a full-color type having four colors, it has development units 21 for respective developing colors, Y (yellow), M (magenta), C (cyan), and K (black) detachably mounted thereon. The rotary idler gear 2 is rotatably provided on the rotary development device 1 so as to engage a drive output gear 8 (not shown) to which a drive is transmitted from a drive motor 8.

A development unit 21 is positioned by providing a positioning pin 16 on a pivotal shaft of the rotary idler gear 2 and inserting the development unit 21 into the rotary development device 1 from under the same as shown in FIG. 1A to fit a positioning hole 19 of the development unit 21 with the positioning pin 16 as shown in FIG. 1B. The development unit 21 is configured so that the development roller 22 can swing about the pivotal shaft on which the positioning pin 16 is provided, the roller 22 swinging in a face-to-face relationship with the photosensitive member 23 (not shown). The elastic member 18 for preventing a loose fit is provided to prevent an undesirable movement or resonance of the development unit 21 by fixing a loose fit between the positioning pin 16 and the positioning hole 19 of the development unit 21 when the positioning pin 16 and the positioning hole 19 of the development unit 21 are fitted to position the development unit 21 as shown in FIG. 1B. The elastic member 18 is constituted by a biasing member that is a plate spring secured to the rotary frame 6 to bias the development unit 21 in one direction.

Figure 2:
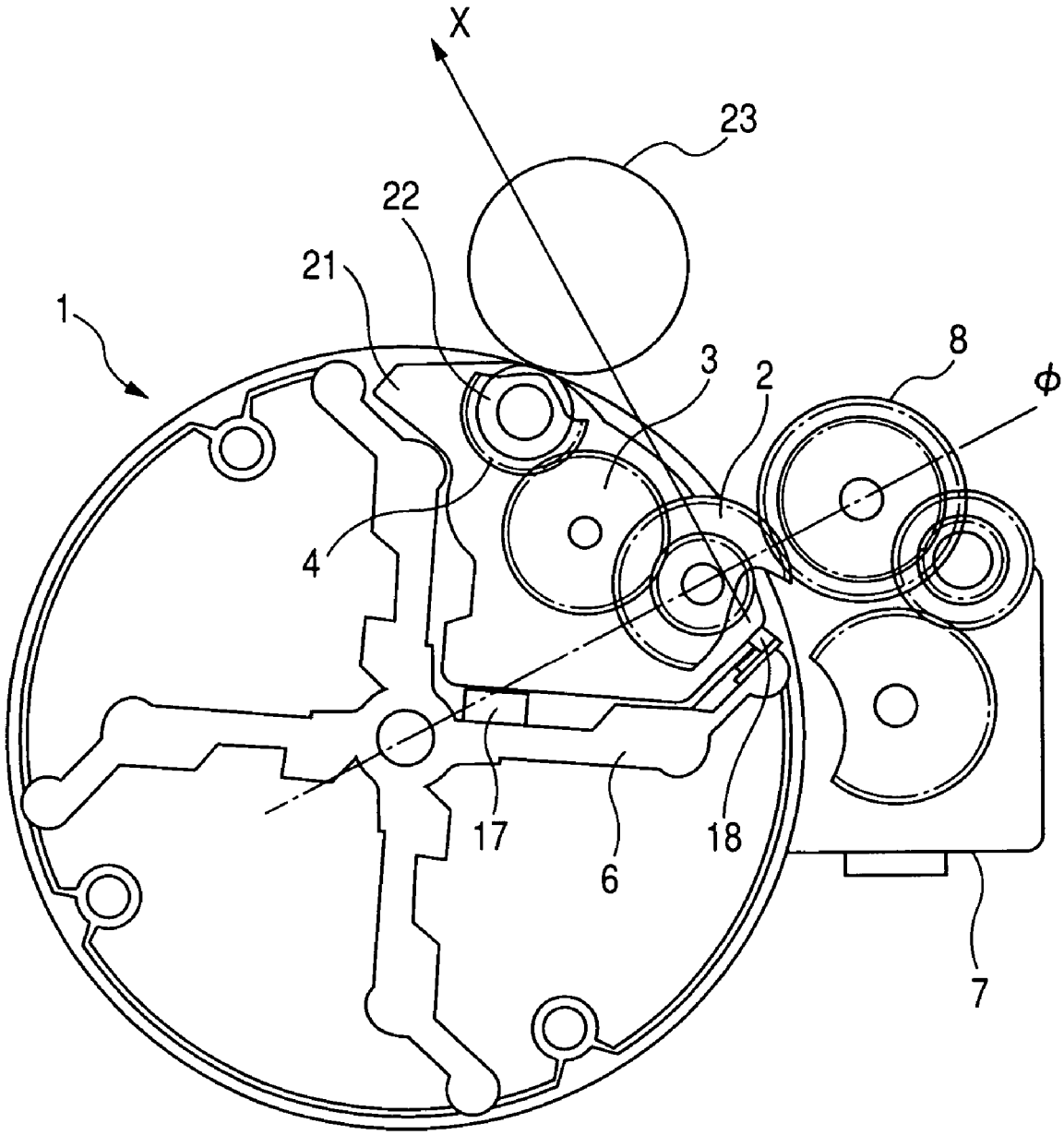
FIG. 2 is an illustration of a train of driving wheels of a development unit and a swing-urging mechanism.

FIG. 2 shows a train of driving wheels of a development unit and a mechanism for urging the development unit for swinging. Reference numeral 7 represents a drive motor, reference numeral 8 represents a drive output gear, and reference numeral 17 represents an urging spring for the development unit. FIGS. 1A and 1B show enlarged views of a region where the positioning pin 16 and the positioning hole 19 of a development unit 21 are fitted for positioning, the view showing a section of the region in parallel with the axis of rotation of the rotary development device 1. FIG. 2 shows the train of driving wheels of the development unit and the mechanism for urging the development unit for swinging as viewed in a section perpendicular to the axis of rotation of the rotary development device 1.

Referring to FIG. 2, the development unit 21 is positioned on a pivotal shaft of the rotary idler gear 2 and configured such that the development roller 22 can swing about the pivotal shaft in a face-to-face relationship with the photosensitive member 23. When the drive output gear 8 is driven counterclockwise and the rotary idler gear 2 is driven clockwise, since the gear strain constituted by the development unit input gear 3 and the development roller gear 4 of the development unit 21 engages the rotary idler gear 2, a driving force generated as a result of the engagement between the rotary idler gear 2 and the development unit input gear 3 in this configuration of the gear train rotates the development unit 21 outwardly in the radial direction of the rotary development device 1 or toward the center of the photosensitive member 23.

Therefore, a drive reaction force acts in the direction of urging the development roller 22 of the development unit 21 against the photosensitive member 23, and the urging spring 17 secured to the rotary frame 5 urges the development roller 22 against the photosensitive member 23 from behind the development unit 21, thereby urging the development unit 21 for swinging. In the presence of those factors urging the development unit 21 for swinging, the elastic member 18 for preventing a loose fit is disposed in the vicinity of the region where the positioning pin 16 and the positioning hole 19 of the development unit 21 are fitted for positioning, the member being provided as a biasing member which provides a bias in a direction x orthogonal to a line $\phi$ connecting the axis of rotation of the rotary development device 1 and the axis of rotation of the photosensitive member 23. In particular, when the biasing force provided by the loose fit preventing elastic member 18 is directed toward the center of the fulcrum, since no component of the force acts against the swing of the development unit 21, stable pressurization can be maintained between the development roller 22 and the photosensitive member 23.

Figure 3A:
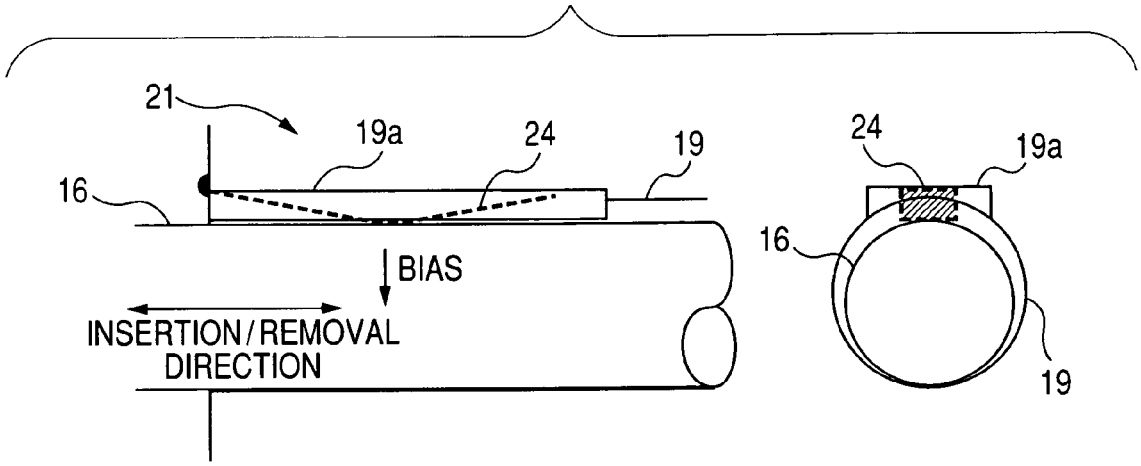
FIGS. 3A and 3B are illustrations showing a second embodiment in which a biasing member is disposed as a loose fit preventing elastic member.
Figure 3B:
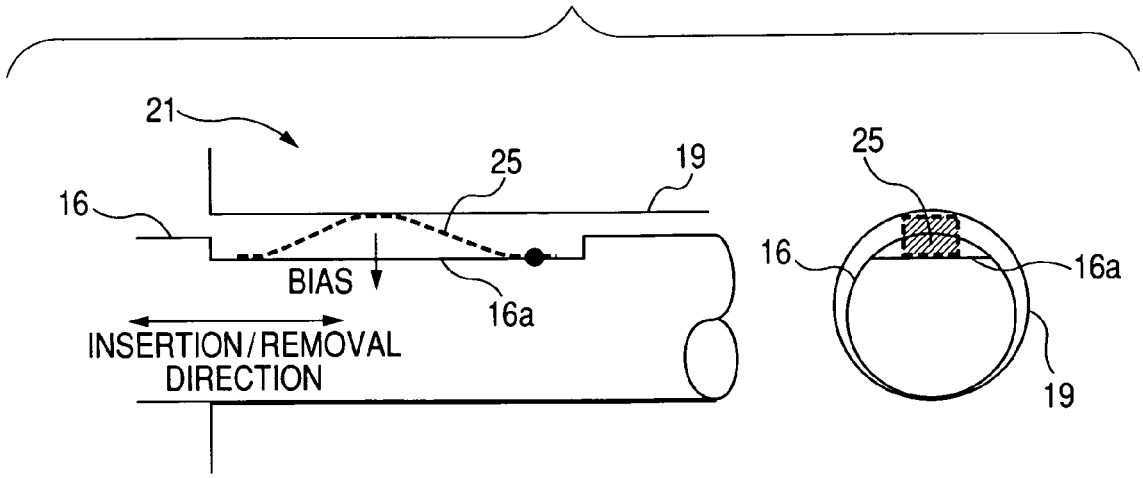
Figure 4A:
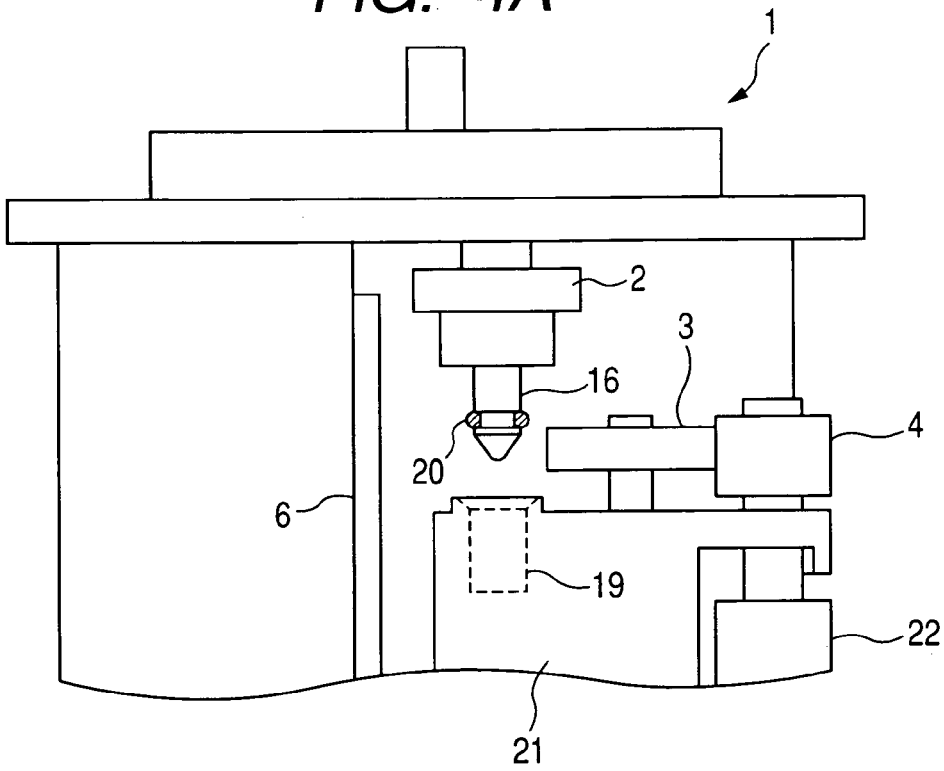
FIGS. 4A and 4B are illustrations showing a third embodiment in which a fitting slack filling member is disposed as a loose fit preventing elastic member.
Figure 4B:
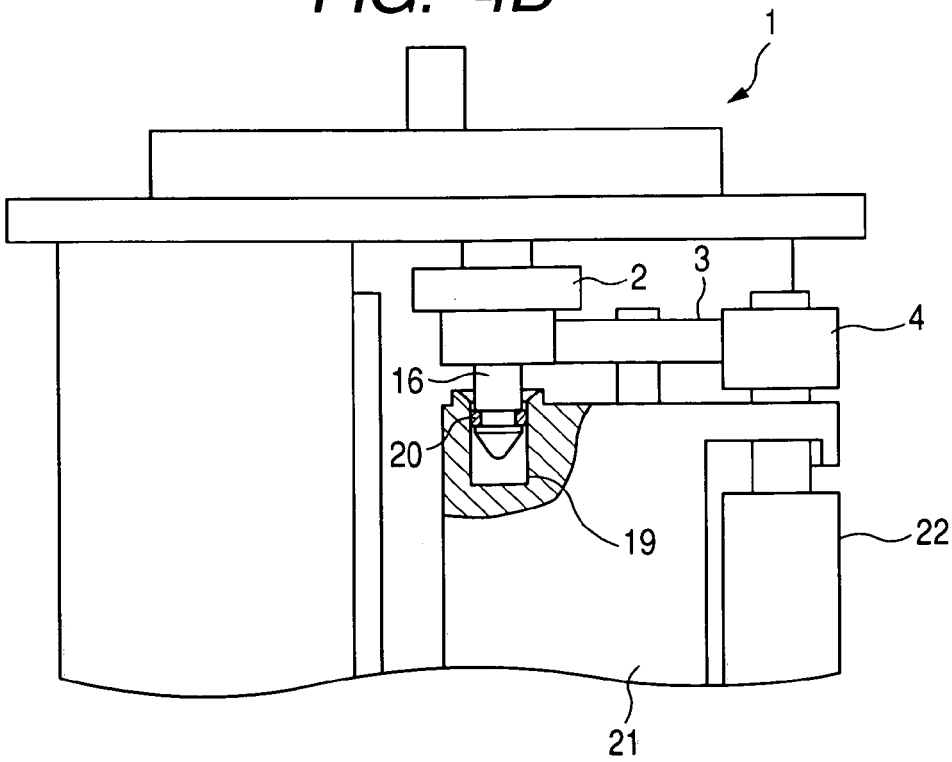

FIGS. 3A and 3B show a biasing member which is disposed as a loose fit preventing elastic member according to the second embodiment, and FIGS. 4A and 4B show a fitting slack filling member which is disposed as a loose fit preventing elastic member according to the third embodiment.

In the first embodiment, as the loose fit preventing elastic member 18, a plate spring is secured to the rotary frame 6 to configure a biasing member for biasing a development unit 21 in one direction. However, a plate spring may alternatively be secured to the positioning pin 16 or in the positioning hole 19 of the development unit 21 between which looseness of fitting exists to bias the development unit 21 in one direction similarly, and such an embodiment is shown in FIGS. 3A and 3B. Specifically, the development unit 21 is cut inside the positioning hole 19 to provide a space 19*a* in which a plate spring 24 is mounted, and the positioning pin 16 may be biased in a predetermined direction by the plate spring 24 secured in the space. Further, the positioning pin 16 may be cut to form a surface on which a plate spring 25 is mounted, and the positioning pin 16 may be biased in a predetermined direction by the plate spring 25 secured to the surface.

Alternatively, a fitting slack filling member may be disposed as a loose fit preventing elastic member in the fitting and positioning region where looseness of fitting exists, and FIGS. 4A and 4B show such an embodiment. An annular groove is provided on the positioning pin 16. An annular elastic member 20 is fitted and secured in the groove as shown in FIGS. 4A and 4B. A development unit 21 is inserted into the rotary development device 1 from below as shown in FIG. 4A. The positioning hole 19 of the development unit 21 is fitted with the positioning pin 16 to which the annular elastic member 20 has been fitted and secured, as shown in FIG. 4B.

According to the third embodiment, since an elastic member is provided to regulate the movement of a development unit 21 such as vibration attributable to a loose fit between the fulcrum 16 of the development unit 21 and the positioning hole 19 of the development unit 21, vibration caused by a drive for development will not be propagated from the rotary frame 6 to the development unit 21, which makes it possible to prevent the occurrence of problems such as an undesirable movement or resonance of the development unit 21 itself. Thus, image defects such as banding attributable such vibration can be eliminated.

Figure 5:
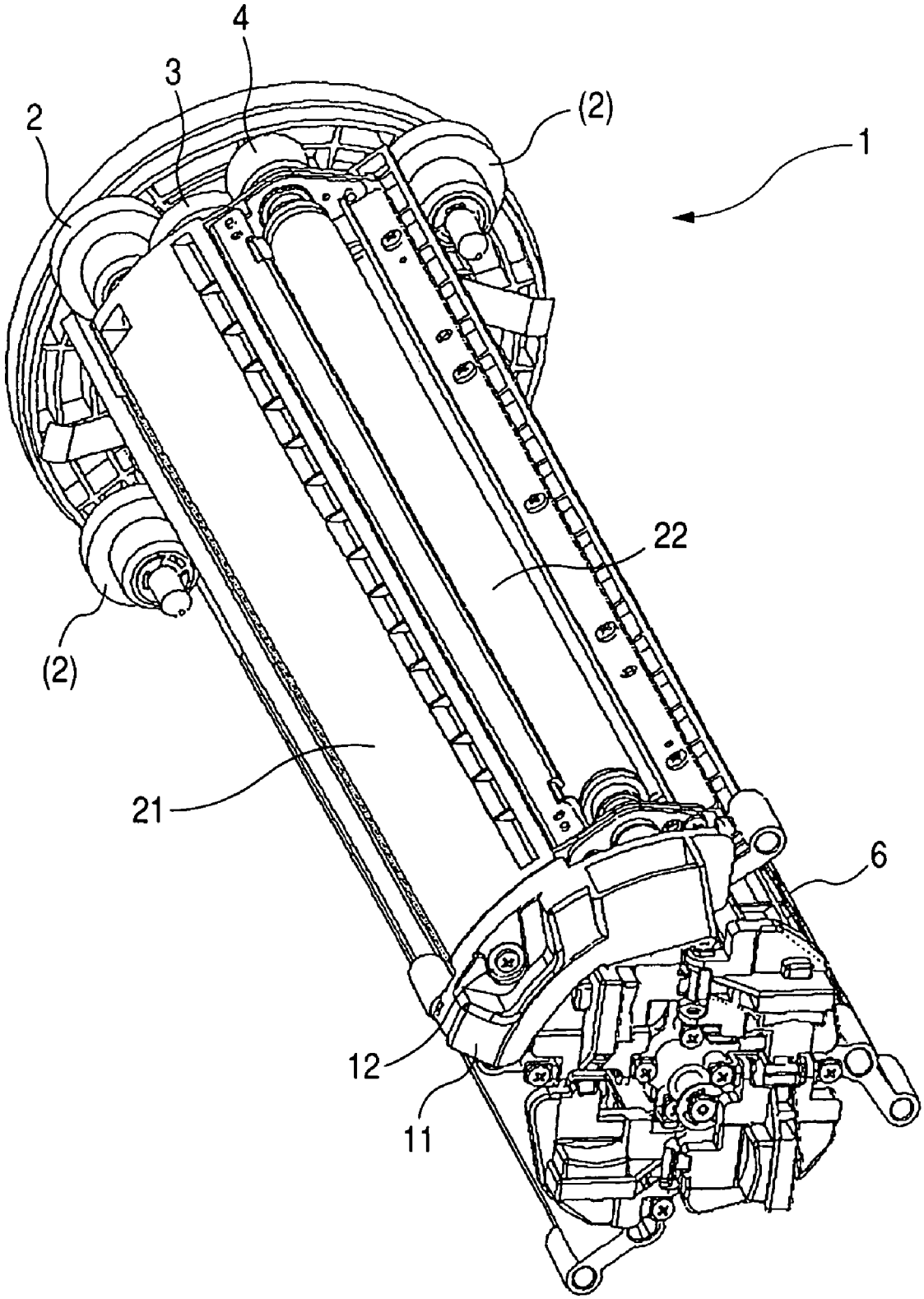
FIG. 5 shows a development unit in a state in which it is mounted on a rotary development device.
Figure 6:
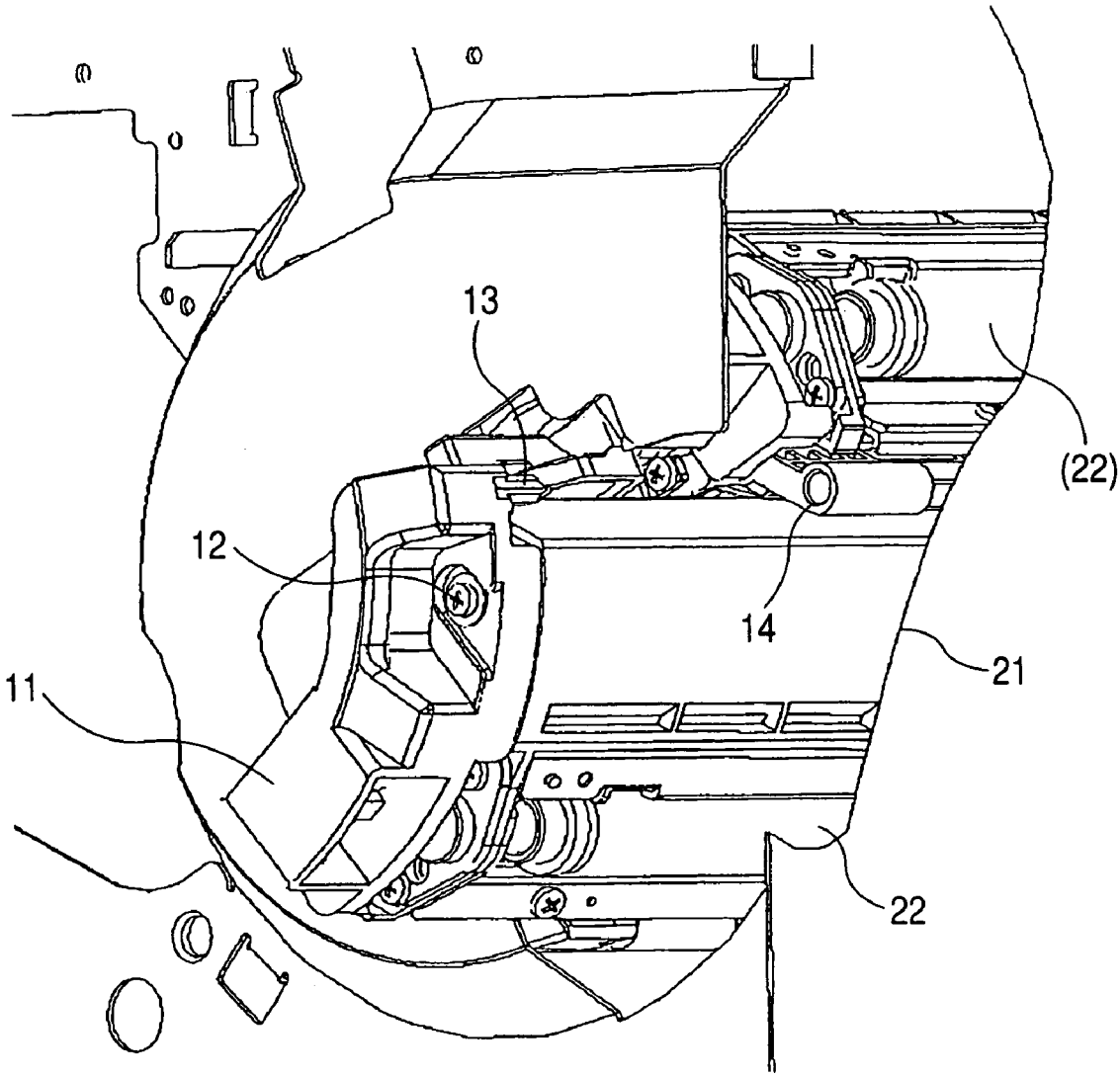
FIG. 6 is an enlarged detailed view of a development unit cover portion in an enlarged scale.
Figure 7:
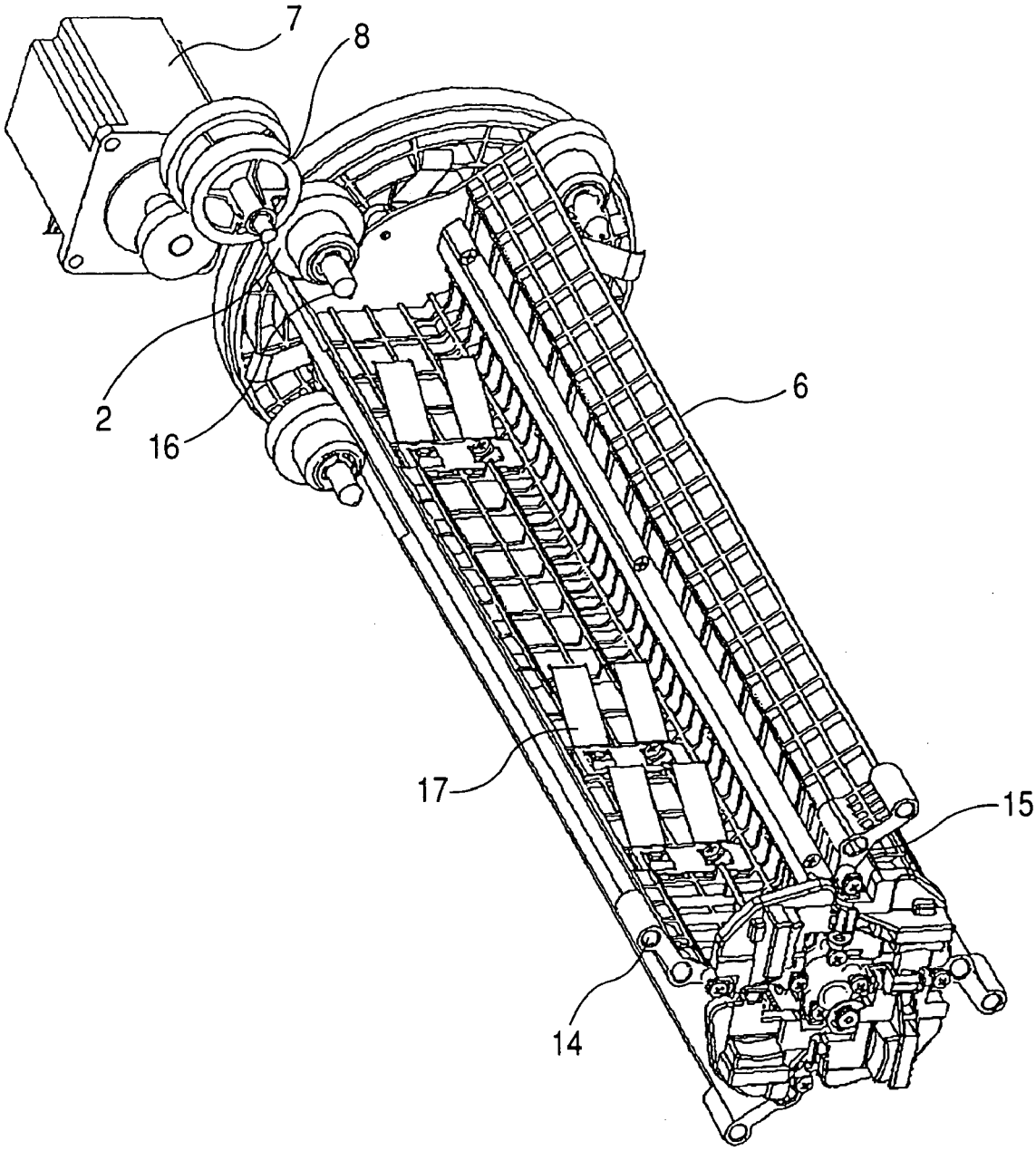
FIG. 7 is an illustration showing positioning of a development unit in a rotary development device, members and a structure for causing a swing, and a state of engagement between a rotary idler gear and a drive output gear.

FIG. 5 shows a development unit mounted on the rotary development device. FIG. 6 shows details of a portion for covering a development unit in an enlarged scale. FIG. 7 shows a structure for positioning and swinging development units in the rotary development device and shows a state of engagement between the rotary idler gear and the drive output gear. In the figure, reference numeral 11 represents the development unit cover, reference numeral 12 represents the fulcrum of the development unit, reference numerals 13 and 16 represent development unit positioning pins, reference numerals 14 and 15 represents development unit positioning holes, and reference numeral 17 represents a development unit urging spring.

FIG. 5 shows the rotary development device 1 with a development unit 21 mounted thereon to serve only one of the four colors, and FIG. 6 is a detailed view of the development unit 21 showing the neighborhood of the development unit cover 11 in an enlarged scale. The development unit cover 11 is provided with a development unit positioning pin 13 and protrusions in two locations on the side thereof opposite to the development roller 22 and is fitted with the development unit positioning hole 14 which is provided on an end face of the rotary frame 6 in a face-to-face relationship with them. The development unit fulcrum 12 is located in a region facing a rotating shaft of a rotary idler gear 2. On the opposite side of the development unit fulcrum 12, a rotary idler gear 2 is provided on the rotary frame 6 as apparent from the view of the interior of the rotary development device 1 shown by omitting the development unit 21. A development unit positioning pin 16 is provided on the rotating shaft of the gear and is engaged with the development unit positioning hole (not shown) of the development unit 21 to swing the development unit 21 between the development unit fulcrum 12 and the same. An urging spring 17 for urging the development unit 21 toward the photosensitive member as shown in FIG. 7 is provided on the rotary frame 6 in the rotary development device 1.

The development unit positioning holes 14 and 15 shown in FIG. 7 engage the development unit positioning pin 13 of the development unit cover 11 shown in FIG. 6 and another development unit positioning pin which is not shown so that the development unit positioning pin 16 engages a development unit positioning hole, which is not shown, of the development unit 21 to position the development unit 21. The development unit is swung by the development unit fulcrum 12 and the development unit positioning pin 16. The rotary idler gear 2 engages the drive output gear 8 as shown in FIG. 7 to be driven by the drive motor 7.

Thus, the development unit 21 can be swingably positioned on the rotary development device 1 with high accuracy by the above-described positioning mechanism. In addition, engagement and disengagement of the gear train at the time of attachment and detachment of the unit occurs between the rotary idler gear 2 provided on the rotary frame 6 and the development unit input gear 3, and positioning is performed using the development unit positioning pin 16 provided at an end of the rotating shaft of the rotary idler gear 2. Thus, the engagement and disengagement can be smoothly performed with reduced play or looseness. When the rotary development device 1 is rotated to move a development unit 21 associated with the color of a developing process to the developing position, the drive output gear 8 engages the rotary idler gear 2 provided on the rotary frame 6 of the rotary development device 1.

Figure 8:
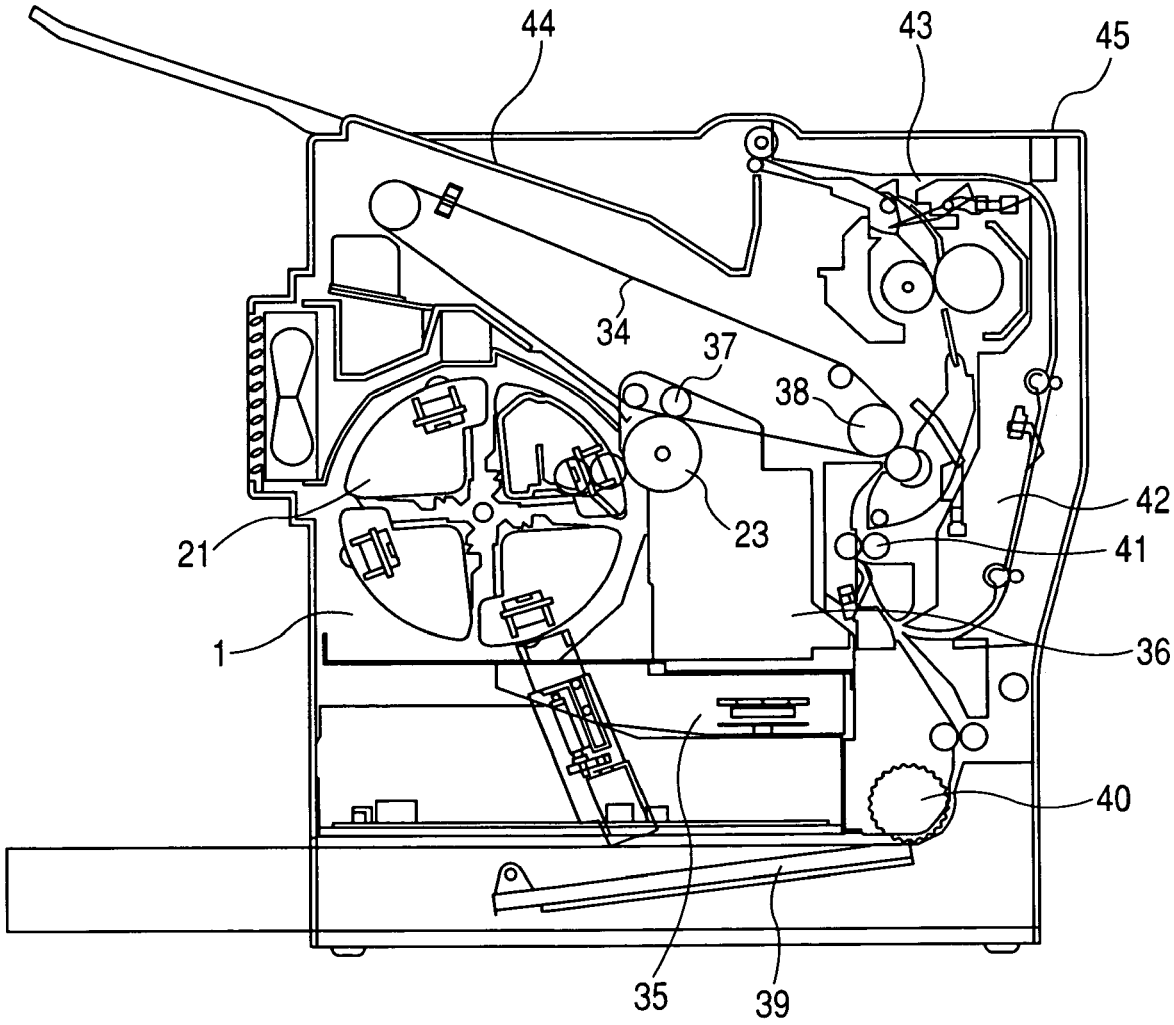
FIG. 8 is an illustration showing an image forming apparatus including the rotary development device according to the invention.

An image forming apparatus to which the present invention is applied will now be described with reference to the drawings. FIG. 8 shows an image forming apparatus according to the invention. In the figure, reference numeral 34 represents an intermediate transfer medium, reference numeral 35 represents an exposure device, reference numeral 36 represents a processing unit, reference numeral 38 represents a secondary transfer device, reference numeral 39 represents a sheet feeding tray, reference numeral 40 represents a sheet feeding roller, reference numeral 41 represents a registration roller, reference numeral 42 represents a sheet conveying unit, reference numeral 43 represents a fixing unit, reference numeral 44 represents a sheet discharge tray, and reference numeral 45 represents a door member.

The image forming apparatus has the sheet discharge tray 44 which is formed at an upper part of a housing as shown in FIG. 8 and the door member 45 which is insertion-mounted on a front face of the housing such that it can be opened and closed. Disposed in the housing are a rotary development device 1 carrying a plurality of development units, a photosensitive member 23 on which an electrostatic latent image is formed and developed into a toner image, the exposure device 35 which exposes the photosensitive member to form an electrostatic latent image thereon, the intermediate transfer medium 34 which is constituted by an endless belt and onto which a toner image is transferred, a primary transfer device 37 for performing a primary transfer of a toner image on the photosensitive member 23 to the intermediate transfer medium 34, a secondary transfer device 38 for performing a secondary transfer of a toner image on the intermediate transfer medium 34 to a recording medium (a sheet of paper or the like), the sheet feeding tray 39 which contains recording media, the fixing unit 43 which fixes a toner image on the recording medium, and a control unit for controlling each drive motor and bias. The sheet conveying unit 42 which conveys a recording media from the sheet feeding tray 39 to the fixing unit 43 through the secondary transfer device 38 is disposed inside the door member 45. Each of the units is configured such that it can be attached and detached to and from the main body and such that it can be integrally removed for a repair or replacement when maintenance is carried out.

The photosensitive member 23 which is an image carrying member has a conductive base material in the form of a thin cylinder and a photosensitive layer formed on a surface thereof. Disposed around the photosensitive member 23 are a charging device (not shown) for uniformly charging the photosensitive member 23 in a rotating direction of the same, the exposure device 35 for forming an electrostatic latent image on the photosensitive member 23, the rotary development device 1 for developing an electrostatic latent image, the intermediate transfer medium 34 to which a toner image on the photosensitive member 23 is transferred, the primary transfer device 37 for performing a primary transfer of a toner image to the intermediate transfer medium 34, and a cleaner (not shown) for cleaning the surface of the photosensitive member 23 after a primary transfer. Thus, an electrostatic latent image formed on the photosensitive member 23 by the exposure device 35 is developed by the rotary development device 1 to form a toner image, and the toner image thus formed is transferred to the intermediate transfer medium 34 by the primary transfer device 37 and is further transferred to a recording medium (a sheet of paper or the like) by the secondary transfer device 38.

In the image forming apparatus having the above-described configuration, when image formation signals from the processing unit 36 are input to the exposure device 35, the photosensitive member 23, development rollers of the rotary development device 1, and the intermediate transfer medium 34 are driven for rotation in accordance with the control over the drive motor and bias exercised by the control unit, which first allows the photosensitive member 23 to be uniformly charged on an outer circumferential surface thereof by the charging device. Thereafter, when N=4 or in the case of full-color configuration serving four colors, selective exposure is performed on the surface of the photosensitive member 23 by the exposure device 35 according to image information on a first color, e.g., yellow (Y) to form an electrostatic latent image in yellow (Y). At this time, the rotary development device 1 rotates such that a development roller of a development unit 21 for yellow (Y) is put in contact with the photosensitive member 23. As a result, a toner image of the electrostatic latent image in yellow (Y) is formed on the photosensitive member 23.

Thereafter, a primary transfer voltage having the polarity opposite to the polarity in which the toner is charged is applied to the primary transfer device 37 to transfer the toner image formed on the photosensitive member 23 onto the intermediate transfer medium 34. In the meantime, the secondary transfer device 38 is spaced from the intermediate transfer medium 34. The series of processes is repeatedly performed in association with image formation signals in second, third, and fourth colors to transfer toner images in the four colors (N=4), i.e., yellow (Y), black (K), cyan (C), and magenta (M) sequentially onto the intermediate transfer medium 34 in an overlapping relationship in accordance with the contents of the respective image formation signals, thereby forming a full-color image thereon.

At the timing when the full-color image reaches the secondary transfer device 38, a recording medium (a sheet of paper) in the sheet feeding tray 9 is conveyed from a conveying path to the secondary transfer device 38 through the sheet feeding roller 40 and the registration roller 41; the secondary transfer device 38 is urged against the intermediate transfer medium 34; and a secondary transfer voltage is applied to transfer the full-color toner image in four colors on the intermediate transfer medium 34 onto the recording medium by the secondary transfer device 38. When the recording medium on which the full-color toner image has been thus transferred is conveyed to the fixing unit 43 by the sheet conveying unit 42, the full-color toner image on the recording medium is fixed by being heated and pressed by the fixing unit 43 and is then discharged onto the sheet discharge tray 44.

The invention is not limited to the above-described embodiments and may be modified in various ways. While an annular elastic member is secured to a positioning pin as an example of a configuration in which an elastic member is disposed between a positioning pin and a wall of a positioning hole in the above-described embodiments, an annular elastic member may alternatively be secured on the wall of the positioning hole. Since a development unit has a predetermined life which requires more frequent replacements than the rotating member constituted by a rotary frame is required, an annular elastic member must have a life longer than that of the development unit when it is secured to the positioning pin, and maintenance such as replacement is required for the member when it is deteriorated. When the annular elastic member is secured to the development unit, the member is only required to have a life equivalent to that of the development unit, and no maintenance is therefore required for the same. Although a positioning hole is provided on a development unit and is engaged with a positioning pin that is provided on a pivotal shaft of a rotary idler gear on a rotary frame, the positioning pin and the positioning hole may conversely be provided on the development unit and the rotary frame, respectively, and may be engaged with each other.

Figure 9:
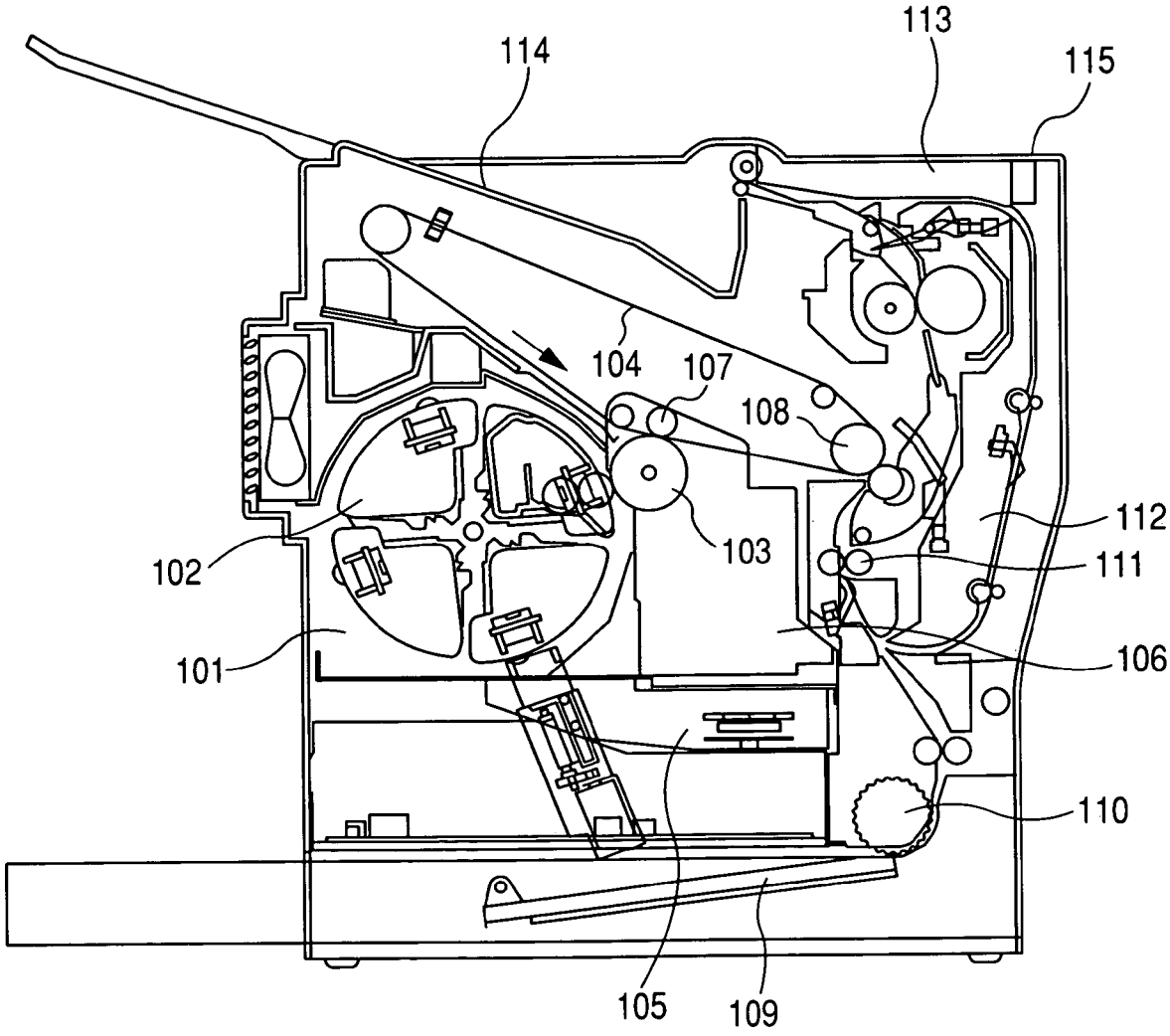
FIG. 9 is an illustration showing an image forming apparatus according to a fourth embodiment of the invention.

Next, a fourth embodiment of the invention will now be described with reference to the drawings. FIG. 9 shows an image forming apparatus according to the fourth embodiment of the invention. Reference numeral 101 represents a rotary development device, reference numeral 102 represents development units, reference numeral 103 represents a photosensitive member, reference numeral 104 represents an intermediate transfer medium, reference numeral 105 represents an exposure device, reference numeral 106 represents a processing unit, reference numeral 107 represents a primary transfer device, reference numeral 108 represents a secondary transfer device, reference numeral 109 represents a sheet feeding tray, reference numeral 110 represents a sheet feeding roller, reference numeral 111 represents a registration roller, reference numeral 112 represents a sheet conveying unit, reference numeral 113 represents a fixing unit, reference numeral 114 represents a sheet discharge tray, and reference numeral 115 represents a door member.

The image forming apparatus of the fourth embodiment has the sheet discharge tray 114 which is formed at an upper part of a housing as shown in FIG. 9 and the door member 115 which is insertion-mounted on a front face of the housing such that it can be opened and closed. A rotary development device 101, a plurality of the development units 102, a photosensitive member 103, the intermediate transfer medium 104, the exposure device 105, a processing unit 106, primary transfer device 107, a secondary transfer device 108, a sheet feeding tray 109, a fixing unit 113, and a control unit and so on are disposed in the housing. The rotary development device 101 carries a plurality of the development units 102. A latent image is formed on the photosensitive member 103 and developed into a toner image. The exposure device 105 exposes the photosensitive member 103 to form a latent image thereon. The intermediate transfer medium 104 is constituted by an endless belt and onto which a toner image is transferred. The processing unit 106 controls a forming of the latent image by the exposure device 105. The primary transfer device 107 performs a primary transfer of a toner image on the photosensitive member 103 to the intermediate transfer medium 104. The secondary transfer device 108 performs a secondary transfer of a toner image on the intermediate transfer medium 104 to a recording medium (a sheet of paper or the like). The sheet feeding tray 109 contains recording media. The fixing unit 113 fixes a toner image on the recording medium, and a control unit for controlling each drive motor and bias. The sheet conveying unit 112 conveys a recording media from the sheet feeding tray 109 to the fixing unit 113 through the secondary transfer device 108 is disposed inside the door member 115. Each of the units is configured such that it can be attached and detached to and from the main body and such that it can be integrally removed for a repair or replacement when maintenance is carried out.

The photosensitive member 103 serving as an image bearing member has a conductive base material in the form of a thin cylinder and a photosensitive layer formed on a surface thereof. Disposed around the photosensitive member 103 are a charging device (not shown) for uniformly charging the photosensitive member 103 in a rotating direction of the photosensitive member 103, the exposure device 105 for forming a latent image on the photosensitive member 103, the rotary development device 101 for developing a latent image, the intermediate transfer medium 104 to which a toner image on the photosensitive member 103 is transferred, the primary transfer device 107 for performing a primary transfer of a toner image to the intermediate transfer medium 104, and a cleaner (not shown) for cleaning the surface of the photosensitive member 103 after a primary transfer. Thus, a latent image formed on the photosensitive member 103 by the exposure device 105 is developed by the rotary development device 101 to form a toner image, and the toner image thus formed is transferred to the intermediate transfer medium 104 by the primary transfer device 107 and is further transferred to a recording medium (a sheet of paper or the like) by the secondary transfer device 108.

In the case of full-color image formation by the image forming apparatus having the above-described configuration, when image formation signals from the processing unit 106 are input to the exposure device 105, the photosensitive member 103, the rotary development device 101, and the intermediate transfer medium 104 are driven for rotation in accordance with the control over the drive motor and bias exercised by the control unit. Thus, the photosensitive member 103 is uniformly charged on an outer circumferential surface thereof by the charging device. Referring to the rotary development device 101, to form a toner image in a first color, e.g., yellow (Y), a developing unit 102 for yellow (Y) is rotated as a result of a developing color switching operation beyond a straight line connecting the axis of rotation of the rotary development device 101 and the axis of rotation of the photosensitive member 103, and the rotation is stopped when a development roller or rollers disposed on both ends of the development roller (this equally applies to the following description) are put contact with the photosensitive member 103 downstream of the straight line as viewed in the rotating direction of the rotary development device 101. At the same time when the development roller of the development unit 102 is driven for rotation, selective exposure is first performed on a surface of the photosensitive member 103 by the exposure device 105 according to image information in the first color, i.e., yellow (Y) to form a latent image in yellow (Y) on the photosensitive member 103. The latent image in yellow (Y) is developed by the development unit 102 to form a toner image on the photosensitive member 103.

Immediately after the development unit 102 develops a rear end of the latent image in yellow (Y) to complete the development or before the rear end of the resultant toner image reaches the primary transfer device 107, the rotary development device 101 starts a developing color switching operation for forming a toner image in the next or second color, e.g., black (K). As a result of the developing color switching operation, a development unit 102 for black (K) rotates beyond the straight line connecting the axis of rotation of the rotary development device 101 and the axis of rotation of the photosensitive member 103 and stops by abutting upon the photosensitive member 103 downstream of the straight line as viewed in the rotating direction of the rotary development device 101.

In the meantime, a primary transfer voltage having the polarity opposite to the polarity in which the toner is charged is applied to the primary transfer device 107, and the toner image thus formed on the photosensitive member 103 is transferred onto the intermediate transfer medium 104 by the primary transfer device 107. The secondary transfer device 108 is spaced from the intermediate transfer medium 104.

When the developing color switching operation for the second color is terminated and the development roller of the development unit 102 for black (K) stops in abutment upon the photosensitive member 103, selective exposure is performed on the surface of the photosensitive member 103 by the exposure device 105 according to image information in the second color or black (K). Such a series of processes is repeatedly performed in association with image formation signals in the second, third, and fourth colors to transfer toner images in the four colors, i.e., yellow (Y), black (K), cyan (C), and magenta (M) sequentially onto the intermediate transfer medium 104 from the photosensitive member 103 in an overlapping relationship in accordance with the contents of the respective image formation signals, thereby forming a full-color image.

At the timing when the full-color image reaches the secondary transfer device 108, a recording medium (a sheet of paper or the like) in the sheet feeding tray 109 is conveyed from a conveying path to the secondary transfer device 108 through the sheet feeding roller 110 and the registration-roller 111, the secondary transfer device 108 is urged against the intermediate transfer medium 104, and a secondary transfer voltage is applied to transfer the full-color toner image in four colors on the intermediate transfer medium 104 onto the recording medium by the secondary transfer device 108. When the recording medium on which the full-color toner image has been thus transferred is conveyed to the fixing unit 113 by the sheet conveying unit 112, the full-color toner image on the recording medium is fixed by being heated and pressed by the fixing unit 113 and is then discharged onto the sheet discharge tray 114.

Figure 10:
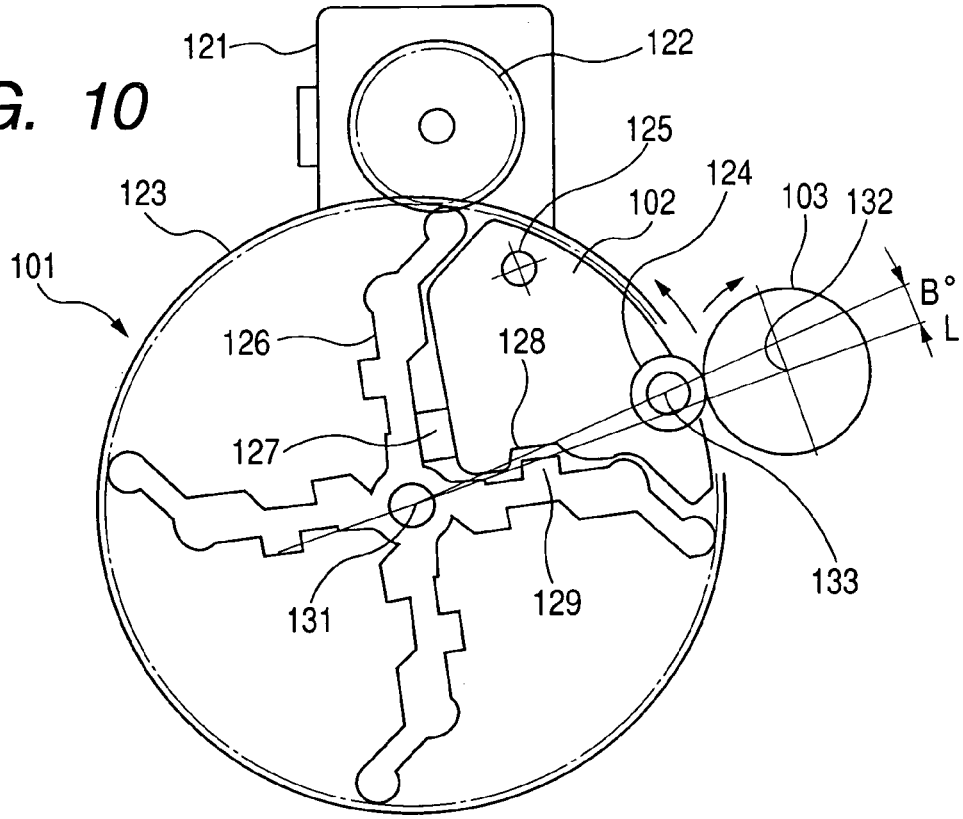
FIG. 10 is an illustration showing a state in which a rotary development device is rotated and positioned as a result of a developing color switching operation to put a development roller in abutment upon a photosensitive member.
Figure 11:
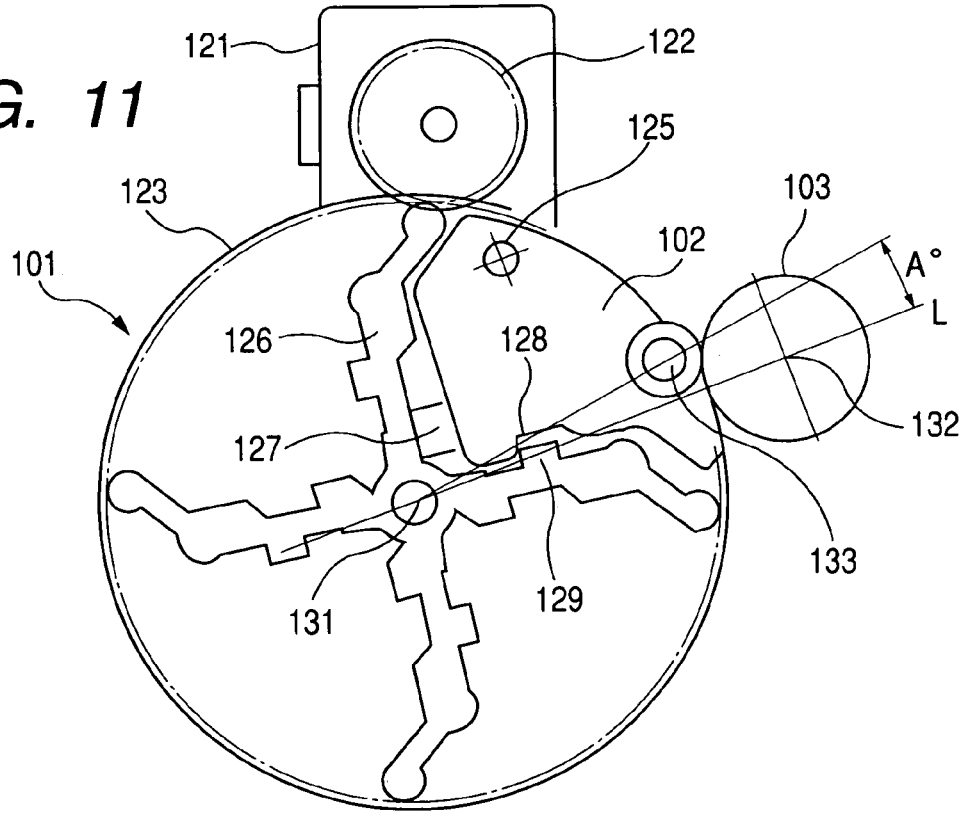
FIG. 11 shows a position where the development roller separates from the photosensitive member as a result of rotation of the rotary development device caused by a developing color switching operation.
Figure 12:
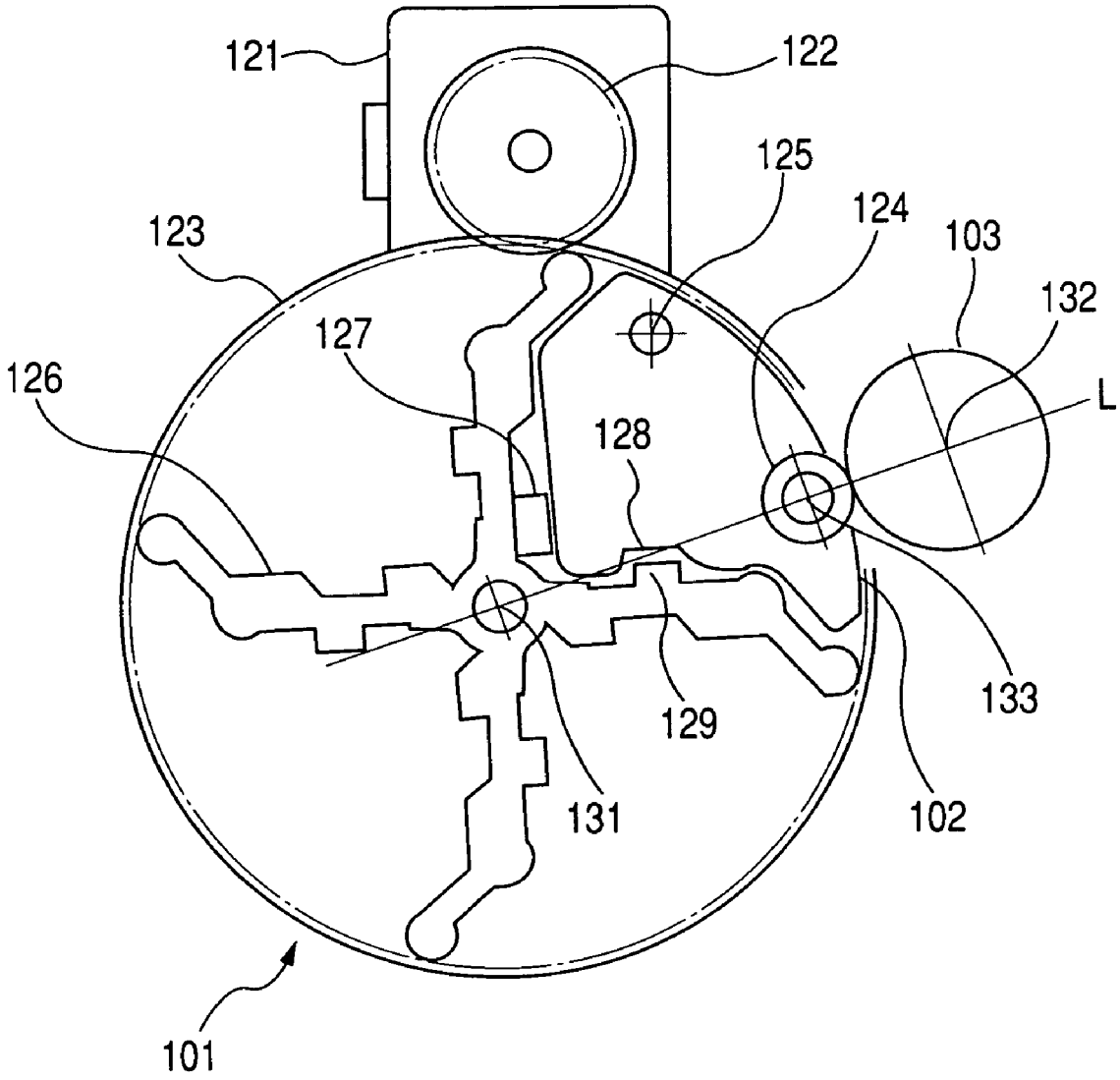
FIG. 12 shows a state in which the development roller is located on a straight line connecting the axis of rotation of the rotary development device and the axis of rotation of the photosensitive member.

FIG. 10 shows a state in which the rotary development device has been rotated and positioned by a developing color switching operation to put a development roller in abutment upon the photosensitive member. FIG. 11 shows the position where the development roller leaves the photosensitive member as a result of rotation of the rotary development device caused by a developing color switching operation. FIG. 12 shows a state in which the development roller is located on the straight line connecting the axis of rotation of the rotary development device and the axis of rotation of the photosensitive member. In the figures, reference numeral 121 represents a drive motor for the rotary development device, reference numeral 122 represents a drive motor gear, reference numeral 123 represents a rotating gear of the rotary development device, reference numeral 124 represents the development roller, reference numeral 125 represents a fulcrum of the development unit, reference numeral 126 represents a rotary frame, reference numeral 127 represents an abutment spring, reference numerals 128 and 129 represent swing regulating portions of the development unit, and reference numerals 131 to 133 represent the axes of rotation.

The rotary development device 101 has the rotary development device rotating gear 123 provided along the outer circumference thereof as shown in FIG. 10, and the rotary development device rotating gear 123 is engaged with the drive motor gear 122 to drive the device 101 by the rotary development device drive motor 121 in a rotating direction that is counterclockwise in the figure. A development unit 102 detachably mounted on the rotary development device 101 is positioned such that its development roller 124 is urged against the photosensitive member 103 on a straight line connecting the axis of rotation 131 of the rotary development device 101 and the axis of rotation 133 of the development roller 124, the straight line being shifted downstream from a straight line L connecting the axis of rotation 131 of the rotary development device 101 and the axis of rotation 132 of the photosensitive member 103 by an angle of rotation B° in the rotating direction.

The development unit 102 is mounted such that it can swing about the development unit fulcrum 125. The swing is regulated by the development unit swing regulating portion 128 of the development unit 102 and the development unit swing regulating portion 29 of the rotary frame 126. The unit is urged toward the photosensitive member 103 by the abutment spring 127 provided on the rotary frame 126 and is put in abutment upon the photosensitive member 103 with a predetermined urging force.

When a developing color switching operation is started by the rotary development device drive motor 121 to rotate the rotary development device 101, the development unit swing regulating portion 128 of the development unit 102 and the development unit swing regulating portion 129 of the rotary frame 126 start regulating the swing of the development unit 102 which has completed the developing operation at an angle of rotation A° shown in FIG. 11, and the development roller 124 leaves the photosensitive member 103. Then, the development unit 102 to perform the next developing operation is positioned such that its development roller 124 abuts upon the photosensitive member 103 as the rotary development device 101 rotates, reaches the line L connecting the axis of rotation 132 of the rotary development device 101 and the axis of rotation 132 of the photosensitive member 103 as shown in FIG. 12, and further abuts upon the photosensitive member 103 after rotating downstream of the line L through the angle of rotation B° shown in FIG. 10 in the rotating direction.

An irregularity or defect of an image can be caused by a movement or irregular rotation of the photosensitive member 103 due to structural looseness provided for fitting and mounting as described above when latent images are formed on the photosensitive member 103 through selective exposure according to image information performed by the exposure device 105. An irregularity or defect of an image attributable to transfer deviation can be similarly caused by a movement or irregular rotation of the photosensitive member 103 also when toner images formed on the photosensitive member 103 are transferred onto the intermediate transfer medium 104 by the primary transfer device 107. Such a movement or irregular rotation of the photosensitive member 103 is more likely to occur, the greater a variation in external forces acting on the photosensitive member 103 or the greater the absolute value of the variation.

The urging force that urges the development roller 124 against the photosensitive member 103 is one of such external forces, and the force is at a maximum and is therefore likely to cause an irregularity of rotation of the photosensitive member 103 when the development roller 124 is on the straight line L connecting the axis of rotation 131 of the rotary development device 101 and the axis of rotation 132 of the photosensitive member 103. Even when the development roller 124 is urged against the photosensitive member 103 on the straight line L connecting the axis of rotation 131 of the rotary development device 101 and the axis of rotation 132 of the photosensitive member 103, a component of the urging force can actually act in the rotating direction of the photosensitive member 103 or in the reverse rotating direction if there is a slight swing to the left or right of the straight line L as a result of a swing of the development unit 102, such a component force constituting a factor that increases the possibility of an irregularity of rotation of the photosensitive member 103.

When the development roller 124 is urged against the photosensitive member 103 in the developing position for a developing operation that is shifted downstream of the straight line L connecting the axis of rotation 131 of the rotary development device 101 and the axis of rotation 132 of the photosensitive member 103 by an angle of rotation B° in the rotating direction as shown in FIG. 10 as in the present embodiment, the urging force can be made smaller than that in the case in which the development roller 124 is urged against the photosensitive member 103 on the straight line L connecting the axis of rotation 131 of the rotary development device 101 and the axis of rotation 132 of the photosensitive member 103 as shown in FIG. 12. In addition, no component of the urging force acts in the rotating direction of the photosensitive member 103 or the reverse rotating direction, and the urging force can be exerted in a predetermined direction. For those reasons, the possibility of a movement or irregular rotation of the photosensitive member 103 can be reduced when the development roller 124 is urged against the photosensitive member 103.

The above-description equally applies when the position in which the development roller 124 is urged against the photosensitive member 103 is shifted upstream in the rotating direction conversely to the downstream shift in the rotating direction shown in FIG. 10. In this case, however, the urging force results in the greatest variation when the development roller 124 passes through the straight line L connecting the axis of rotation 131 of the rotary development device 101 and the axis of rotation 132 of the photosensitive member 103 immediately after a developing color switching operation of the rotary development device 101 is started. Specifically, the urging force for urging the development roller 124 against the photosensitive member 103 starts increasing immediately after the developing color switching operation of the rotary development device 101 is started, reaches a maximum on the straight line L, and then decreases to zero. In addition, a component of the urging force are reversed with respect to the rotating direction of the photosensitive member 103 when the roller passes through the straight line L on which the urging force is maximized as described above. That is, the component changes from a braking component to an accelerating component which maximizes the possibility of an irregularity of rotation of the photosensitive member 103.

Therefore, when such a development color switching operation of the rotary development device 101 is performed during a transfer of a toner image on the photosensitive member 103 onto the intermediate transfer medium 104 by the primary transfer device 107, a transfer irregularity attributable to a movement or irregularity of rotation of the photosensitive member 103 becomes more significant. In this case, such a developing color switching operation of the rotary development device 101 cannot be performed until the transfer is completed even if the developing operation has been completed. It is therefore impossible to proceed to operations for forming an image in the next developing color quickly.

When development is performed by urging the development roller 124 against the photosensitive member 103 in a position shifted downstream of the straight line L connecting the axis of rotation 131 of the rotary development device 101 and the axis of rotation 132 of the photosensitive member 103 by an angle of rotation B° as described in the present embodiment and shown in FIG. 10, developing color switching at the rotary development device 101 for moving the next development unit 102 to the developing position can be immediately after the development unit 102 develops a rear end of a latent image formed on the photosensitive member 103. As a result, no movement or irregular rotation of the photosensitive member 103 occurs unlike a case in which development is performed by urging the development roller 124 against the photosensitive member 103 upstream in the rotating direction immediately after a developing color switching operation is started, and it is therefore possible to eliminate transfer deviation during a primary transfer.

Recent demand for image forming apparatus having higher printing speeds has made it necessary to improve an image forming apparatus employing a rotary development device 101 so that the rotary development device 101 for switching development units 102 takes a shorter time for development color switching operations and rotates and a higher speed. There is another need for reducing the intervals between images on the intermediate transfer medium 104 (sheet gaps). In the present embodiment, when a development unit 102 develops a rear end of a latent image formed on the photosensitive member 103, a development color switching operation of the rotary development device 101 in which the development unit 102 for the next color quickly moves to the developing position can be started immediately even if a toner image thus developed is still in the process of transfer onto the intermediate transfer medium 104 performed by the primary transfer device 107.

When development is performed while urging the development roller 124 against the photosensitive member 103 in a position shifted downstream of the straight line L connecting the axis of rotation 131 of the rotary development device 101 and the axis of rotation 132 of the photosensitive member 103 by an angle of rotation B° as described in the present embodiment and shown in FIG. 10, the photosensitive member 103 can undergo the greatest movement or irregular rotation immediately just before the end of a developing color switching operation of the rotary development device 101 because, at that time, the roller passes through the straight line L on which the urging force is maximized. However, since the rear end of the toner image has already been transferred onto the intermediate transfer medium 104 by the primary transfer device 107 to complete the primary transfer at that point in time, any adverse effect on the transfer can be avoided. It is desirable that the exposure device 105 starts selective exposure according to image information for forming a latent image on the photosensitive member 103 after a developing color switching operation of the rotary development device 101 is completed because the exposure will not be adversely affected by a movement or irregular rotation of the photosensitive member 103 that can occur when the roller passes through the straight line L on which the urging force is maximized immediately before the end of the developing color switching operation.

When development is performed while urging the development roller 124 against the photosensitive member 103 in a position shifted downstream of the straight line L connecting the axis of rotation 131 of the rotary development device 101 and the axis of rotation 132 of the photosensitive member 103 by an angle of rotation B° as described in the present embodiment and shown in FIG. 10, the operation may be regarded in another aspect as urging the development roller 124 against the photosensitive member 103 in a direction downstream of the axis of rotation of the photosensitive member 103 as viewed in the rotating direction. This allows the above-described urging force to be reduced or moderated to reduce or moderate any variation of the urging force immediately after a developing color switching operation of the rotary development device 101. For this purpose, the position of the development fulcrum 25 is required to be set relative to the position for urging the development roller 124 against the photosensitive member 103 such that the development roller 124 is urged against the photosensitive member 103 in a direction that is shifted from a straight line connecting the axis of rotation 133 of the development roller 124 and the axis of rotation 132 of the photosensitive member 103 downstream in the rotating direction of the photosensitive member 103 by a predetermined angle.

The invention is not limited to the above-described embodiment and may be modified in various ways. For example, although an exposure device that forms an electrostatic latent image by exposing a photosensitive member has been described as a latent image forming member in the above embodiment, it is needless to say that other latent image forming member including the use of a writing electrode work similarly.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A rotary development device, comprising:

a rotating member;

a development unit, which is detachably mounted on the rotating member;

an engaging member, which engages the rotating member and the development unit, the engaging member provided so that a positioning pin is fitted into a positioning hole, wherein the positioning pin is provided on a pivotal shaft of an idler gear on the rotating member which is engaged with a drive output gear in a developing position; and wherein the positioning hole is provided on the development unit at a position corresponding to the positioning pin to be fitted; and a biasing member, which biases either the development unit or the rotating member so that the positioning pin is biased to an inner face of the positioning hole.

2. The rotary development device as set forth in claim 1, wherein the biasing member is provided in a vicinity of the engaging member.

3. The rotary development device as set forth in claim 1, further comprising a photosensitive member, on which a latent image is formed, the latent image being developed by the development unit, wherein the biasing member applies a bias in a direction orthogonal to a line connecting an axis of rotation of the rotating member and an axis of rotation of the photosensitive member.

4. The rotary development device as set forth in claim 1, wherein the biasing member applies a bias toward the positioning pin of the engaging member.

5. The rotary development device as set forth in claim 1, wherein the biasing member is an elastic member which is provided between the rotating member and the development unit.

6. The rotary development device as set forth in claim 1, wherein the biasing member is an elastic member which is provided between the positioning pin and the positioning hole.

7. A rotary development device, comprising:

a rotating member;

a development unit, which is detachably mounted on the rotating member;

an engaging member, which engages the rotating member and the development unit, the engaging member provided so that a positioning pin is fitted into a positioning hole; and an elastic member, which is provided on the positioning pin, wherein the elastic member is intimately contacted with inner circumference of the positioning hole.

8. The rotary development device as set forth in claim 7, wherein the elastic member has an annular shape; and wherein the elastic member is provided around an outer circumference of the positioning pin.

9. An image forming apparatus, comprising the rotary development device according to any one of claims 1 to 6, 7 or 8.

* * * * *